US007296625B2

(12) United States Patent
East, Jr.

(10) Patent No.: US 7,296,625 B2
(45) Date of Patent: Nov. 20, 2007

(54) METHODS OF FORMING PACKS IN A PLURALITY OF PERFORATIONS IN A CASING OF A WELLBORE

(75) Inventor: Loyd E. East, Jr., Tomball, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 224 days.

(21) Appl. No.: 11/195,162

(22) Filed: Aug. 2, 2005

(65) Prior Publication Data

US 2007/0029086 A1 Feb. 8, 2007

(51) Int. Cl.
*E21B 37/00* (2006.01)
*E21B 33/13* (2006.01)
*E21B 43/114* (2006.01)

(52) U.S. Cl. ..... 166/290; 166/55.1; 166/280.1; 166/292; 166/294; 166/295; 166/298; 166/812; 166/384

(58) Field of Classification Search ..... 166/55.1, 166/278, 280.1, 285, 290, 292, 294, 295, 166/298, 312, 384
See application file for complete search history.

(56) References Cited

U.S. PATENT DOCUMENTS 2,054,353 A * 9/1936 Yowell ..... 166/254.1
2,749,989 A * 6/1956 Huber ..... 166/290
2,785,754 A * 3/1957 True ..... 175/4.51
2,837,165 A 6/1958 Roberts
2,844,205 A * 7/1958 Carothers ..... 166/250.01
2,911,048 A * 11/1959 Kenneday et al. ..... 166/115
3,161,235 A 12/1964 Carr
3,489,222 A * 1/1970 Love et al. ..... 166/290
5,499,678 A * 3/1996 Surjaatmadja et al. ..... 166/298
5,765,642 A 6/1998 Surjaatmadja ..... 166/297
5,833,000 A 11/1998 Weaver et al. ..... 166/276

(Continued)

FOREIGN PATENT DOCUMENTS

WO WO 03/064811 A2 8/2003

OTHER PUBLICATIONS

U.S. Appl. No. 10/864,061, filed Jun. 9, 2004, Blauch, et al.

(Continued)

*Primary Examiner*—George Suchfield
(74) *Attorney, Agent, or Firm*—Robert A. Kent; Crutsinger & Booth

(57) ABSTRACT

The invention provides a method of forming packs in a plurality of perforations in a casing of a wellbore, the method comprising the steps of: (a) forming a plug of a plugging particulate material in the wellbore of the casing, wherein the plug covers at least one perforation in the casing; (b) forming a pack of a first packing particulate material in at least one perforation located above the plug in the casing; (c) removing at least an upper portion of the plug to expose the at least one perforation in the casing that had been previously covered by at least the upper portion of the plug; and (d) forming a pack of a second packing particulate material in the at least one perforation exposed by removing at least the upper portion of the plug, wherein the second packing particulate material can be the same or different from the first packing particulate material.

24 Claims, 10 Drawing Sheets

U.S. PATENT DOCUMENTS

| | | | | |
|---|---|---|---|---|
| 5,839,510 | A | 11/1998 | Weaver et al. | 166/276 |
| 5,853,048 | A | 12/1998 | Weaver et al. | 166/279 |
| 6,394,184 | B2 * | 5/2002 | Tolman et al. | 166/281 |
| 6,439,309 | B1 | 8/2002 | Matherly et al. | 166/276 |
| 6,446,727 | B1 | 9/2002 | Zemlak | |
| 6,491,098 | B1 * | 12/2002 | Dallas | 166/297 |
| 2005/0061508 | A1 | 3/2005 | Surjaatmadja | |
| 2006/0118301 | A1 * | 6/2006 | East et al. | 166/280.2 |

OTHER PUBLICATIONS

U.S. Appl. No. 10/864,618, filed Jun. 9, 2004, Blauch, et al.
U.S. Appl. No. 11/004,441, filed Dec. 3, 2004, Loyd E. East, Jr., et al.
Foreign communciation related to a counterpart application dated Oct. 20, 2006.

* cited by examiner

METHODS OF FORMING PACKS IN A PLURALITY OF PERFORATIONS IN A CASING OF A WELLBORE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

FIELD OF THE INVENTION

The invention relates to methods for stimulating oil and/or gas production through a plurality of perforations in a casing of a wellbore penetrating one or more subterranean formations. More particularly, the invention relates to methods of forming particulate packs in a plurality of perforations in a casing of a wellbore.

BACKGROUND

To produce hydrocarbons (e.g., crude oil, natural gas, etc.) from the earth, a wellbore can be drilled that penetrates one or more hydrocarbon-bearing strata or subterranean formations, also known as reservoir formations. As used herein, the "perforated interval" or "production interval" is the section of a wellbore that has been prepared for production by creating channels between the reservoir formation and the wellbore. In many cases, long reservoir sections will be perforated in several intervals, with short sections of unperforated casing between each interval to enable isolation devices, like packers, to be set for subsequent treatments or remedial operations.

Generally, after a wellbore has been drilled to a desired depth, completion operations can be performed, which is the assembly of downhole tubulars and equipment required to enable production from an oil or gas well. Completion operations can involve the insertion of casing into a wellbore, and thereafter the casing, if desired, can be cemented into place. To produce hydrocarbon from the subterranean formation, one or more perforations can be created that penetrate through the casing, through the cement, and into the production interval.

At some point in the completion operation, a stimulation operation can be performed to enhance hydrocarbon production from the wellbore. Stimulation is a treatment performed to restore or enhance the productivity of a well. Stimulation treatments fall into two main groups, hydraulic fracturing treatments and matrix treatments. Fracturing treatments are performed above the fracture pressure of the reservoir formation and create a highly conductive flow path between the reservoir and the wellbore. Matrix treatments are performed below the reservoir fracture pressure and generally are designed to restore the natural permeability of the reservoir following damage to the near-wellbore area. Thus, stimulation operations can include hydraulic fracturing, acidizing, fracture acidizing, or other suitable stimulation operations.

After the stimulation operation, the wellbore can be placed into production. Generally, the produced hydrocarbons flow from the reservoir, through the perforations of the production intervals with the wellbore and through the wellbore to the surface.

Problems can result in stimulation operations where the wellbore penetrates multiple production intervals due to the variation of fracture gradients between these intervals. The most depleted of the production intervals typically have the lowest fracture gradients among the multiple production intervals. When a stimulation operation is simultaneously conducted on all of the production intervals, the treatment fluid can preferentially enter the most depleted intervals. Therefore, the stimulation operation often does not obtain the full benefit of the stimulation in those production intervals having relatively higher fracture gradients.

One method conventionally used to overcome problems encountered during the stimulation of a subterranean formation having multiple production intervals has been to use packers and/or bridge plugs to isolate the particular production interval before the stimulation operations. This can be problematic, however, due to the existence of open perforations in the wellbore and the potential sticking of these mechanical isolation devices.

Another method conventionally used to overcome problems encountered during the stimulation of a subterranean formation having multiple production intervals has been to perform a remedial cementing operation prior to the stimulation operation to plug the open perforations in the wellbore. This hopefully prevents the undesired entry of the stimulation fluid into the most depleted intervals of the wellbore. After the pre-existing perforations of a depleted production interval have been plugged with cement, the particular production interval can later be re-perforated, isolated, and then stimulated. While these remedial cementing operations can plug the pre-existing perforations and thus reduce the entry of the stimulation fluid into undesired portions of the formation, remedial cementing operations are often complicated and time consuming. This can require multiple remedial cementing operations to ensure complete plugging of all the pre-existing perforations. In addition, remedial cementing operations can damage near wellbore areas of the subterranean formation and/or require further remedial operations to remove undesired cement damage from the near-wellbore area before the well can be placed back into production.

What is needed in the art are improved methods to pack perforations with a consolidating proppant that will allow diversion of treatment fluids to newly perforated intervals during stimulation treatments in wellbores with a plurality of perforated intervals.

SUMMARY

The invention relates to subterranean stimulation operations and, more particularly, to methods of stimulating a subterranean formation comprising multiple production intervals. The invention provides a method of forming packs in a plurality of perforations in a casing of a wellbore, the method comprising the steps of: (a) forming a plug of a plugging particulate material in the wellbore of the casing, wherein the plug covers at least one perforation in the casing; (b) forming a pack of a first packing particulate material in at least one perforation located above the plug in the casing; (c) removing at least an upper portion of the plug to expose the at least one perforation in the casing that had been previously covered by at least the upper portion of the plug; and (d) forming a pack of a second packing particulate material in the at least one perforation exposed by removing at least the upper portion of the plug, wherein the second packing particulate material can be the same or different from the first packing particulate material.

The invention also provides a method of forming packs in a plurality of perforations in a casing of a wellbore, the method comprising the steps of: (a) forming a plug of a plugging particulate material in the wellbore of the casing, wherein the plug covers at least one perforation in the casing, and wherein at least one perforation is left exposed above the upper portion of the plug; (b) forming a pack of a first packing particulate material in at least one perforation in the casing located above the plug; (c) removing at least an upper portion of the plug to expose the at least one perforation in the casing that had been previously covered by at least the upper portion of the plug; (d) forming a pack of a second packing particulate material in the at least one perforation exposed by removing at least the upper portion of the plug, wherein the second packing particulate material can be the same or different from the first packing particulate material; (e) perforating the casing to form at least one perforation in the casing; and (f) stimulating through the at least one perforation.

The invention also provides a method of forming packs in a plurality of perforations in a casing of a wellbore, the method comprising the steps of: (a) forming a plug of a plugging particulate material in the wellbore of the casing, wherein the plug covers at least one perforation in the casing, and wherein at least one perforation is left exposed above the upper portion of the plug; (b) forming a pack of a first packing particulate material in at least one perforation in the casing located above the plug; (c) removing at least an upper portion of the plug to expose the at least one perforation in the casing that had been previously covered by at least the upper portion of the plug; (d) forming a pack of a second packing particulate material in the at least one perforation exposed by removing at least the upper portion of the plug, wherein the second packing particulate material can be the same or different from the first packing particulate material; (e) perforating the casing to form at least one perforation in the casing by positioning a hydraulic jetting tool adjacent to the casing and jetting a jetting fluid through the hydraulic jetting tool and against the casing; and (f) stimulating through the at least one perforation by jetting a jetting fluid through the at least one nozzle in the hydraulic jetting tool into the at least one perforation.

These and other aspects of the invention will be apparent to one skilled in the art upon reading the following detailed description. While the invention is subject to various modifications and alternative forms, specific embodiments thereof will be described in detail and shown by way of example. It should be understood, however, that it is not intended to limit the invention to the particular forms disclosed, but, on the contrary, the invention is to cover all modifications and alternatives falling within the spirit and scope of the invention as expressed in the appended claims.

DRAWINGS

A more complete understanding of the present disclosure and advantages thereof can be acquired by referring to the following description taken in conjunction with the accompanying drawings, wherein.

Figure 5:
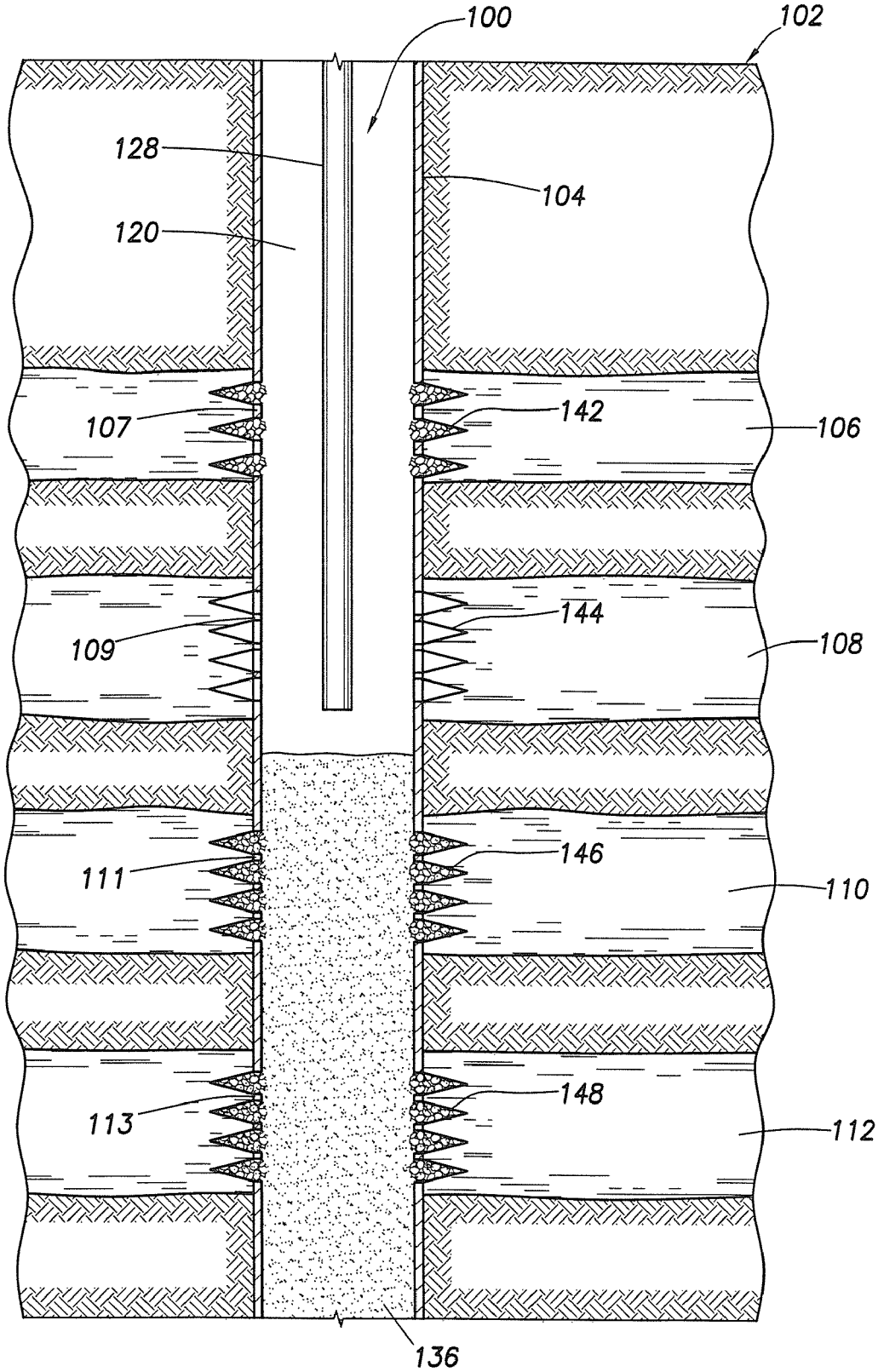
Figure 6:
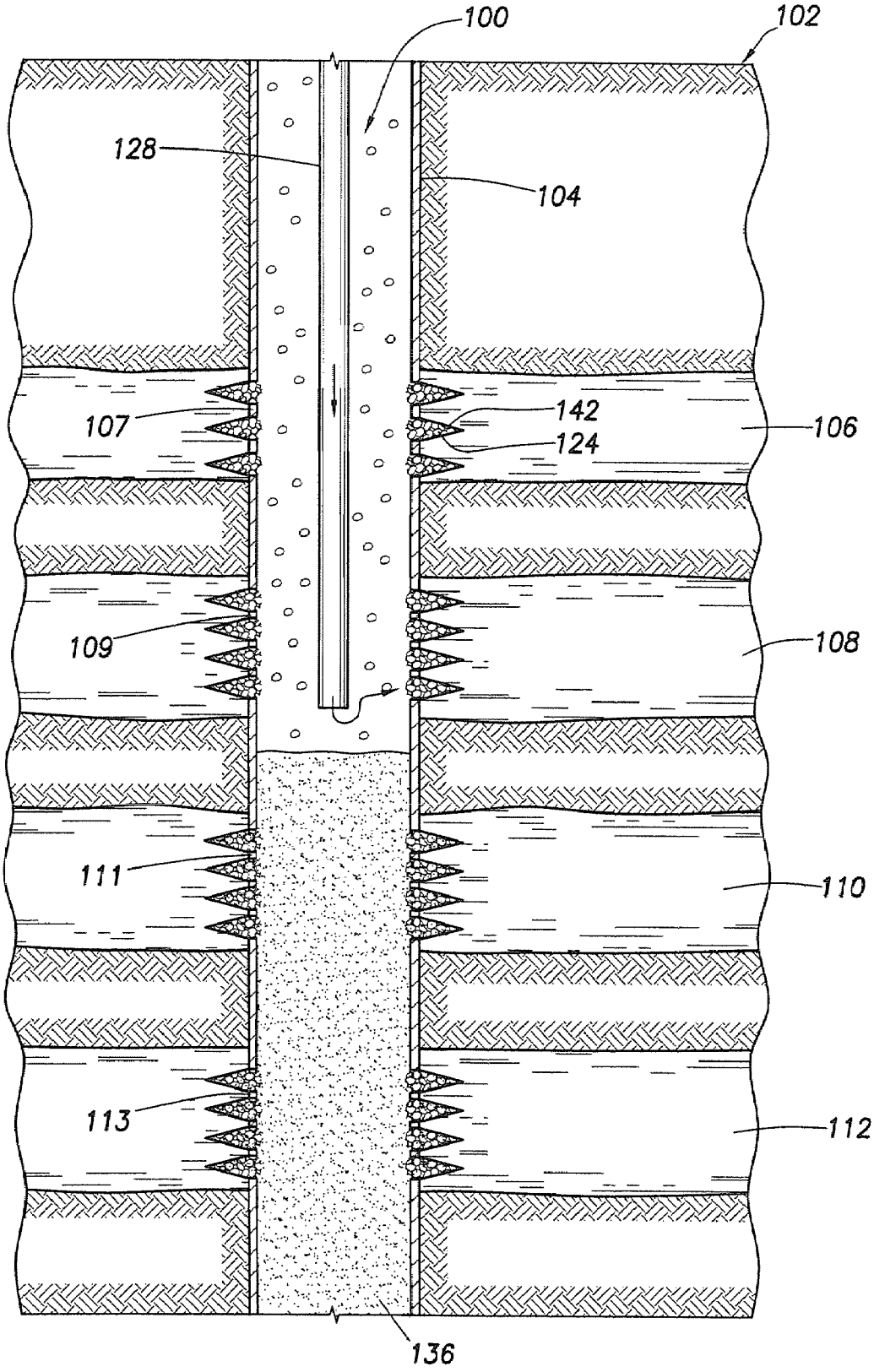
Figure 7:
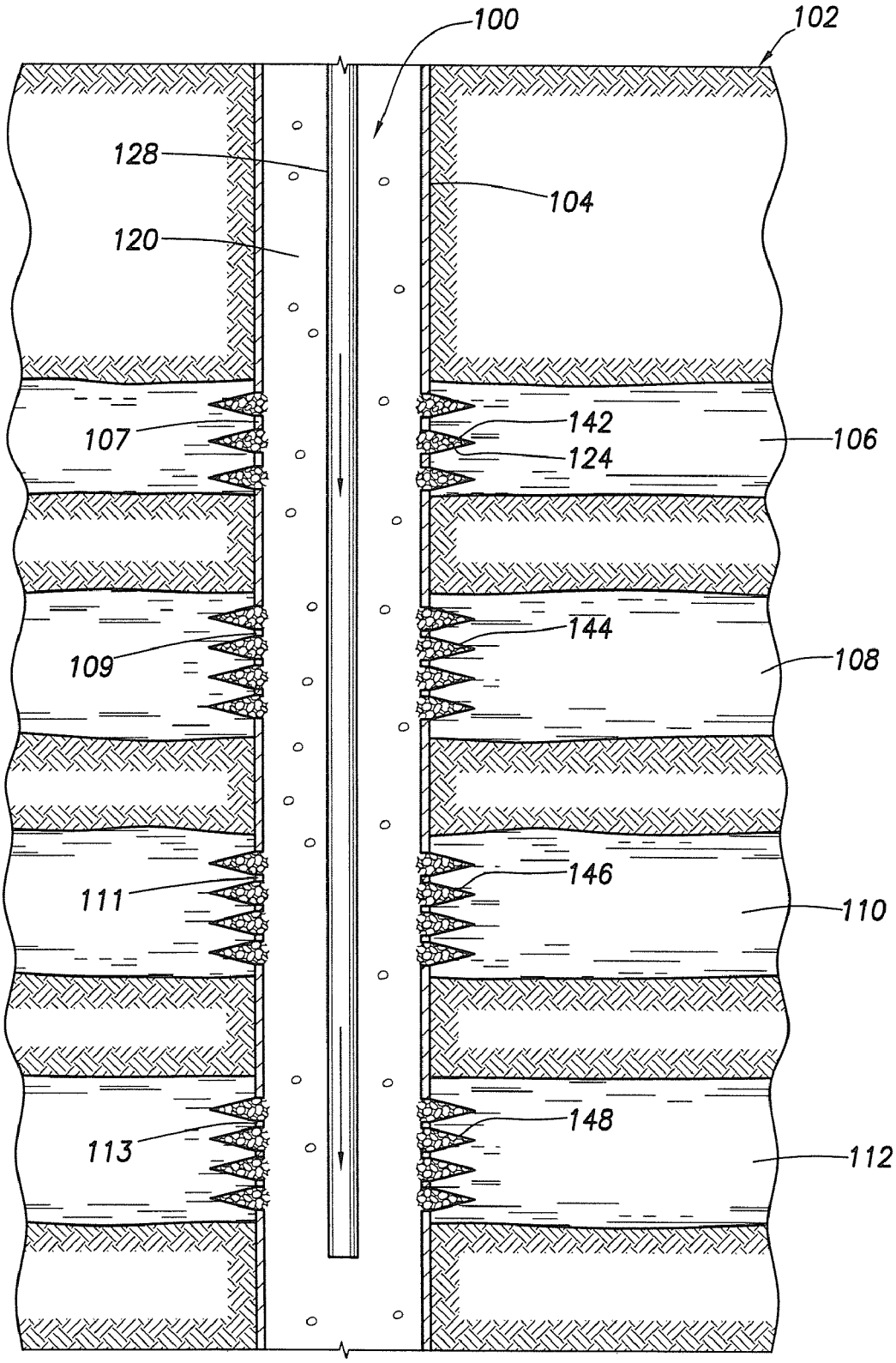
Figure 8:
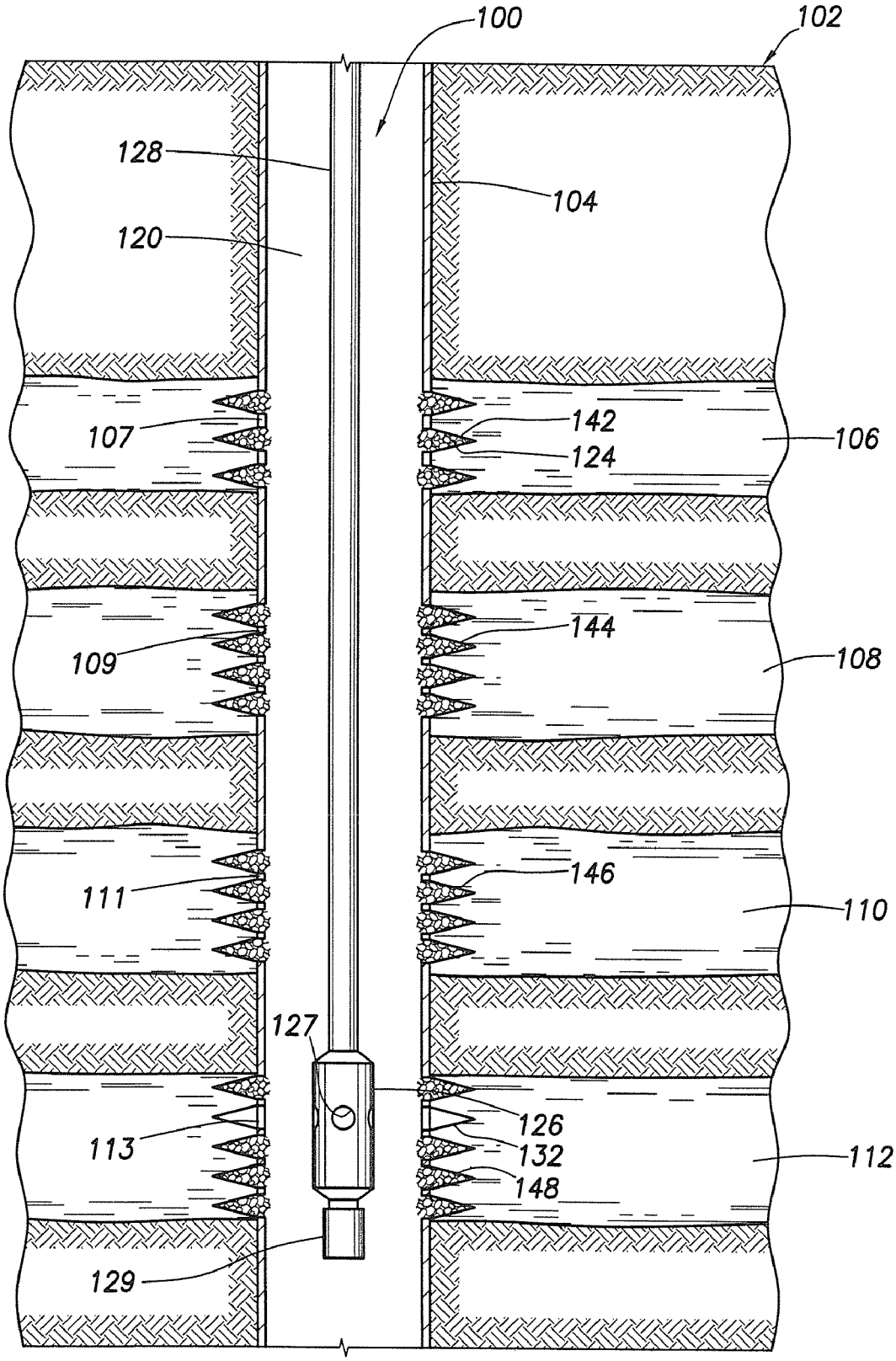
Figure 9:
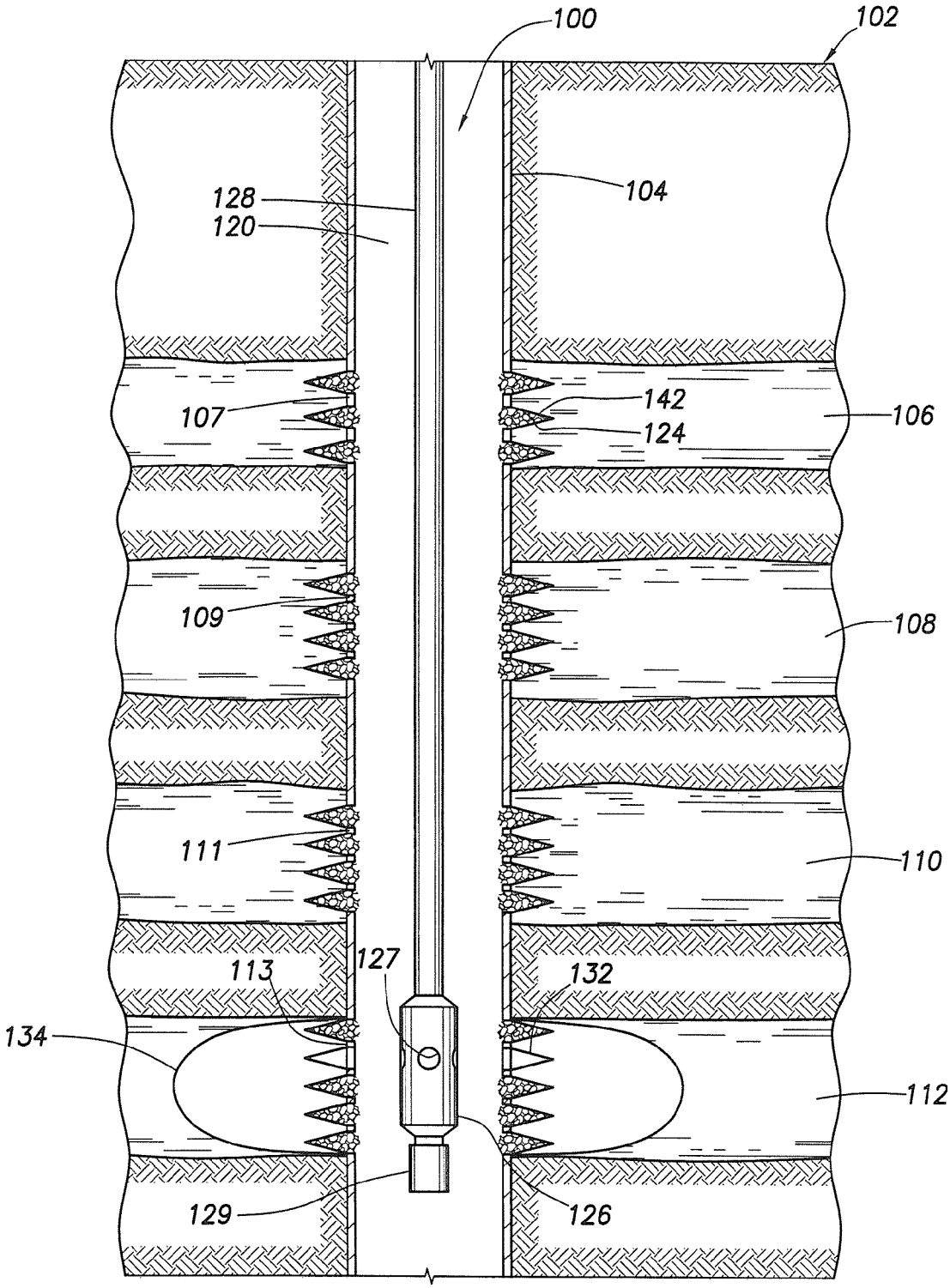
Figure 10:
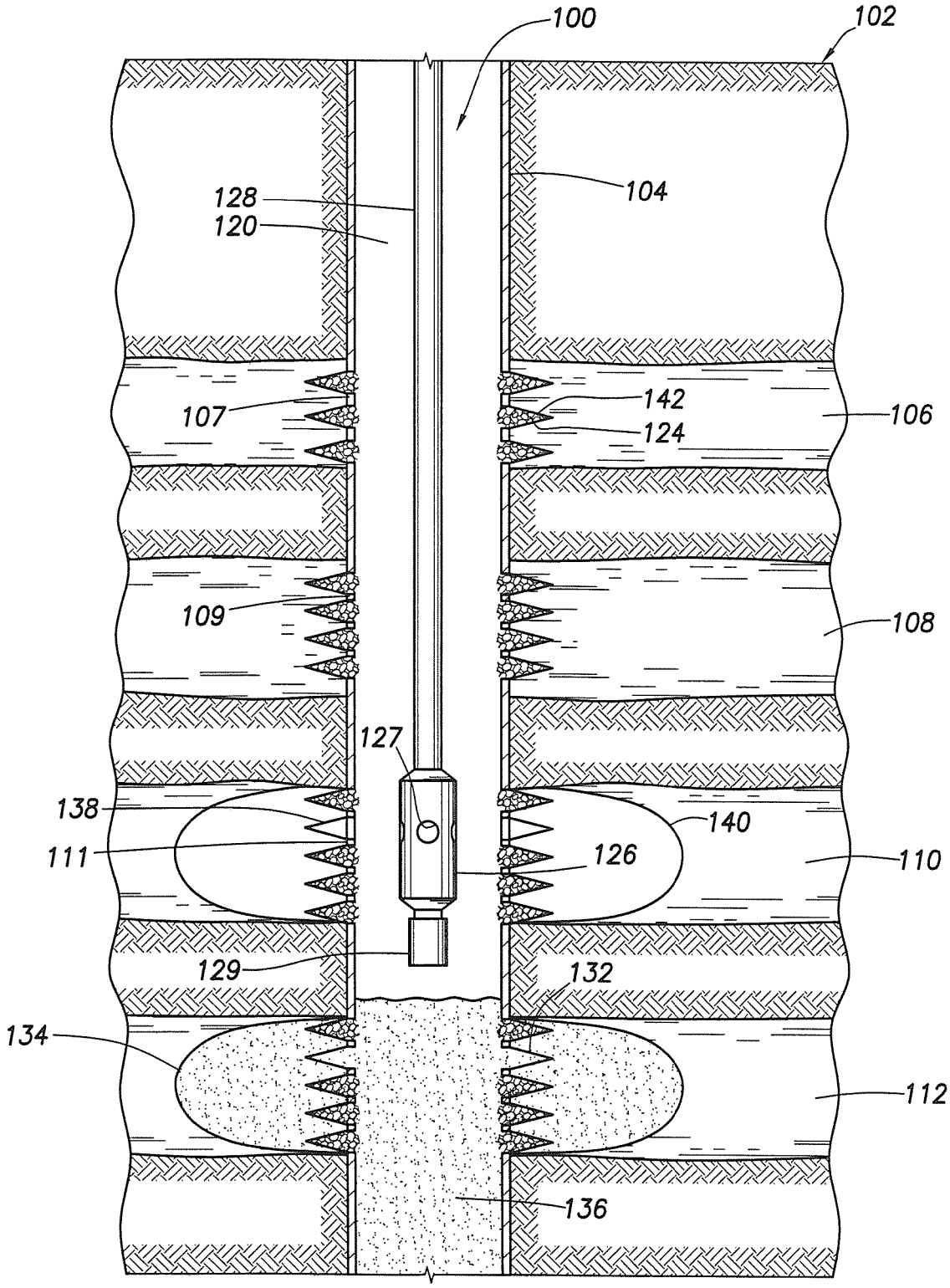

FIG. 5 illustrated is a cross-sectional side view of the wellbore, wherein a conduit is lowered into the wellbore and a washing fluid is circulated to remove the upper portion of the plug of plugging particulate material to expose at least one perforation in the casing that had been previously covered by at least the upper portion of the plug;

FIG. 6, illustrates a cross-sectional side view of the wellbore, wherein a pack of second packing particulate material is formed in at least one perforation exposed by removing at least the upper portion of the plug;

FIG. 7, illustrates a cross-sectional side view of the wellbore, wherein all perforations in the casing are packed with particulate material by successively repeating the steps of removing at least a next upper portion of the plug and forming a pack of a next packing particulate material;

FIG. 8, illustrates a cross-sectional side view of the wellbore having a hydraulic jetting tool disposed therein after creation of perforations in the casing;

FIG. 9 illustrates a cross-sectional side view of the wellbore after creation of fractures in an interval of the subterranean formation; and FIG. 10 illustrates a cross-sectional side view of the wellbore having a hydraulic jetting tool in position for perforating an interval of the wellbore.

DESCRIPTION

The method of the invention provides packing perforated and stimulating intervals with a consolidating proppant that will resist fracturing and allow diversion of treatment fluids to newly perforated intervals. Packing proppant into existing perforations prior to remedial stimulation can be done in a variety of methods.

U.S. patent application Ser. No. 11/004,441, filed on Dec. 3, 2004, having named inventors Loyd E. East, Jr., Travis W. Cavender, and David J. Attaway, which is herein incorporated by reference in its entirety, describes a method of packing perforations by running pipe to the first interval from the bottom up and then circulating particulate and carrier fluid to achieve a particulate pack (i.e., simultaneously packing all the open perforations).

The method of the invention advantageously provides a method of serially packing perforations by running pipe to the first interval from the top to bottom and then circulating particulate and carrier fluid to achieve a particulate pack (i.e., packing each level of open perforations separately). By isolating individual packing levels during a packing operation to serially pack all the perforations in the casing, the invention advantageously packs all perforations completely, thereby avoiding leaking into the wellbore.

The method of the invention provides forming packs in a plurality of perforations in a casing of the wellbore, the method comprising the steps of: (a) forming a plug of a plugging particulate material in the bore of a casing, wherein the plug covers at least one perforation in the casing; (b) forming a pack of a first packing particulate material in at least one perforation in the casing located above the plug; (c) removing at least an upper portion of the plug to expose the at least one perforation in the casing that had been previously covered by at least the upper portion of the plug; and (d) forming a pack of a second packing particulate material in the at least one perforation exposed by removing at least the upper portion of the plug, wherein the second packing particulate material can be the same or different from the first packing particulate material.

The invention relates to methods for stimulating oil and/or gas production through a plurality of perforations in a casing of a wellbore penetrating one or more subterranean formations. More particularly, the invention relates to methods of forming particulate packs in a plurality of perforations in a casing of a wellbore.

While the methods of the invention are useful in a variety of applications, they can be particularly useful for stimulation operations in coal-bed-methane wells, high-permeability reservoirs suffering from near-wellbore compaction, or any well containing multiple perforated intervals that need stimulation. Among other applications, the methods of the invention allow for covering perforations in certain production intervals of a wellbore so that a desired production interval or intervals of the subterranean formation can be stimulated.

The wellbore can be a primary wellbore or a branch wellbore that extends from a primary wellbore. Although the invention is described with respect to a wellbore shown in a vertical orientation, the methods according to the invention can be advantageously practiced in a section of a wellbore in any orientation, regardless of being substantially vertical, horizontal, or any orientation in between.

Figure 1:
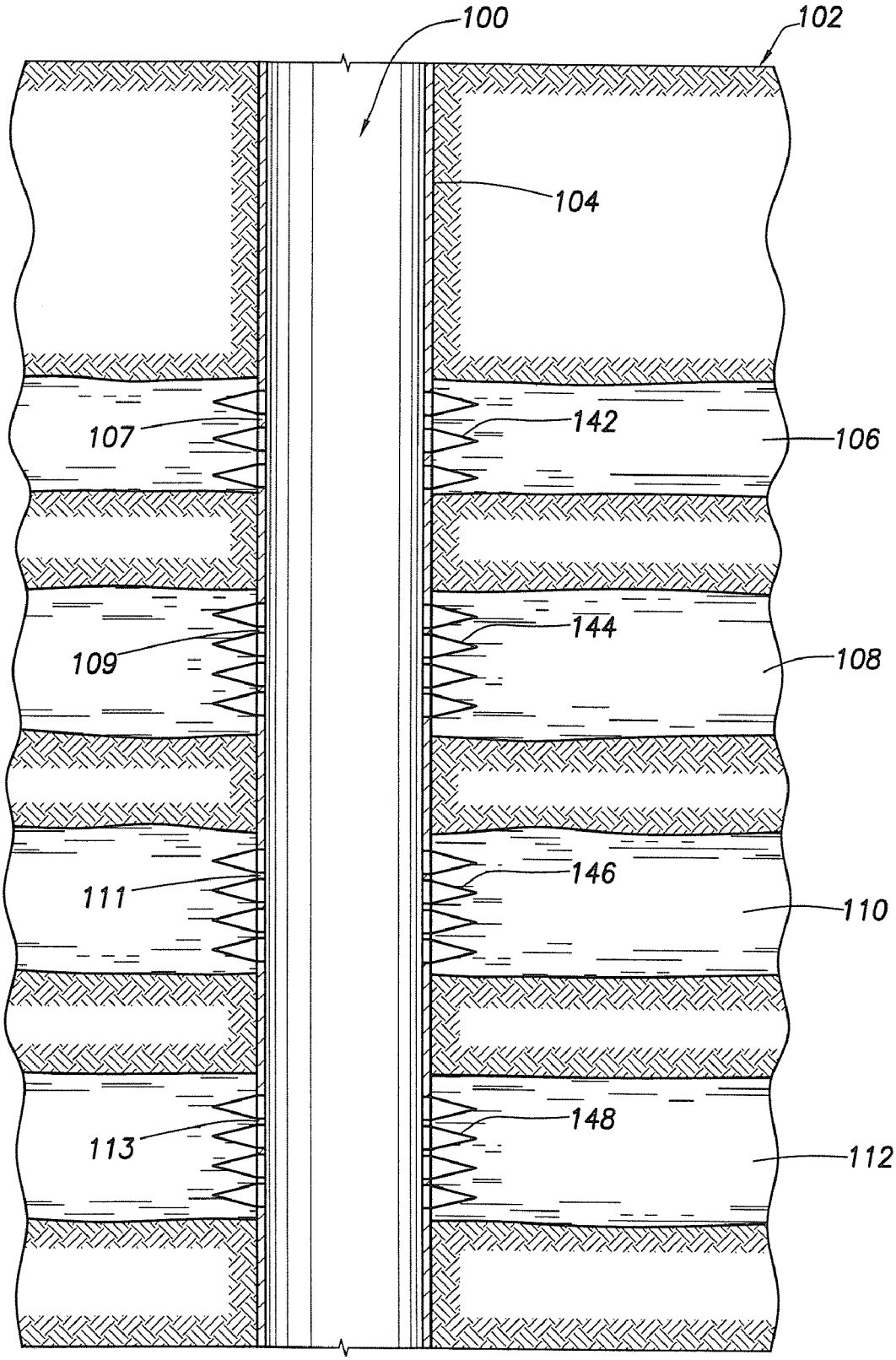
FIG. 1 illustrates a cross-sectional side view of a vertical wellbore that penetrates multiple production intervals.

Turning initially to FIG. 1, illustrated is a cross-sectional side view of a vertical wellbore 100 that penetrates multiple production intervals 106, 108, 110, 112 in accordance with one embodiment of the invention.

The wellbore is generally indicated at 100. While wellbore 100 is depicted as a generally vertical wellbore, the methods of the invention can be performed in generally horizontal, inclined, or otherwise oriented portions of a wellbore. Accordingly, as used herein, the term "upper" as used in the phrases "upper portion of the plug," "next upper portion," "uppermost," and the like means toward the "uphole" side of the wellbore, including for applications where the wellbore is horizontal. As used herein, terms such as "first," "second," "third," "next," etc. are arbitrarily assigned and are merely intended to differentiate between two or more parts that are similar or corresponding in structure and/or function. It is to be understood that the words "first" and "second" serve no other purpose and are not part of the name or description of the following terms. Furthermore, it is to be understood that that the mere use of the term "first" does not require that there be any "second" similar or corresponding part, either as part of the same element or as part of another element. Similarly, the mere use of the word "second" does not require that there by any "third" or "next" similar or corresponding part, either as part of the same element or as part of another element, etc. In addition, wellbore 100 can include multilaterals, wherein wellbore 100 can be a primary wellbore having one or more branch wellbores extending therefrom, or wellbore 100 can be a branch wellbore extending from a primary wellbore.

Wellbore 100 penetrates subterranean formation 102 and has casing 104 disposed therein. Casing 104 may or may not be cemented in wellbore 100 by a cement sheath (not shown). While FIG. 1 depicts wellbore 100 as a cased wellbore, a portion of wellbore 100 can be left openhole.

Generally, subterranean formation 102 contains multiple production intervals, including uppermost or first production interval 106, second production interval 108, third production interval 110, and fourth production interval 112. The intervals of casing 104 adjacent to production intervals 106, 108, 110, 112 are perforated by plurality of perforations 142, 144, 146, 148, such as perforations 142 of first production interval 106, wherein plurality of perforations penetrate through casing 104, through the cement sheath (if present), and into production intervals 106, 108, 110, 112. The intervals of casing 104 adjacent to production intervals 106, 108, 110, 112 are first casing interval 107, second casing interval 109, third casing interval 111, and fourth casing interval 113, respectively.

Figure 2:
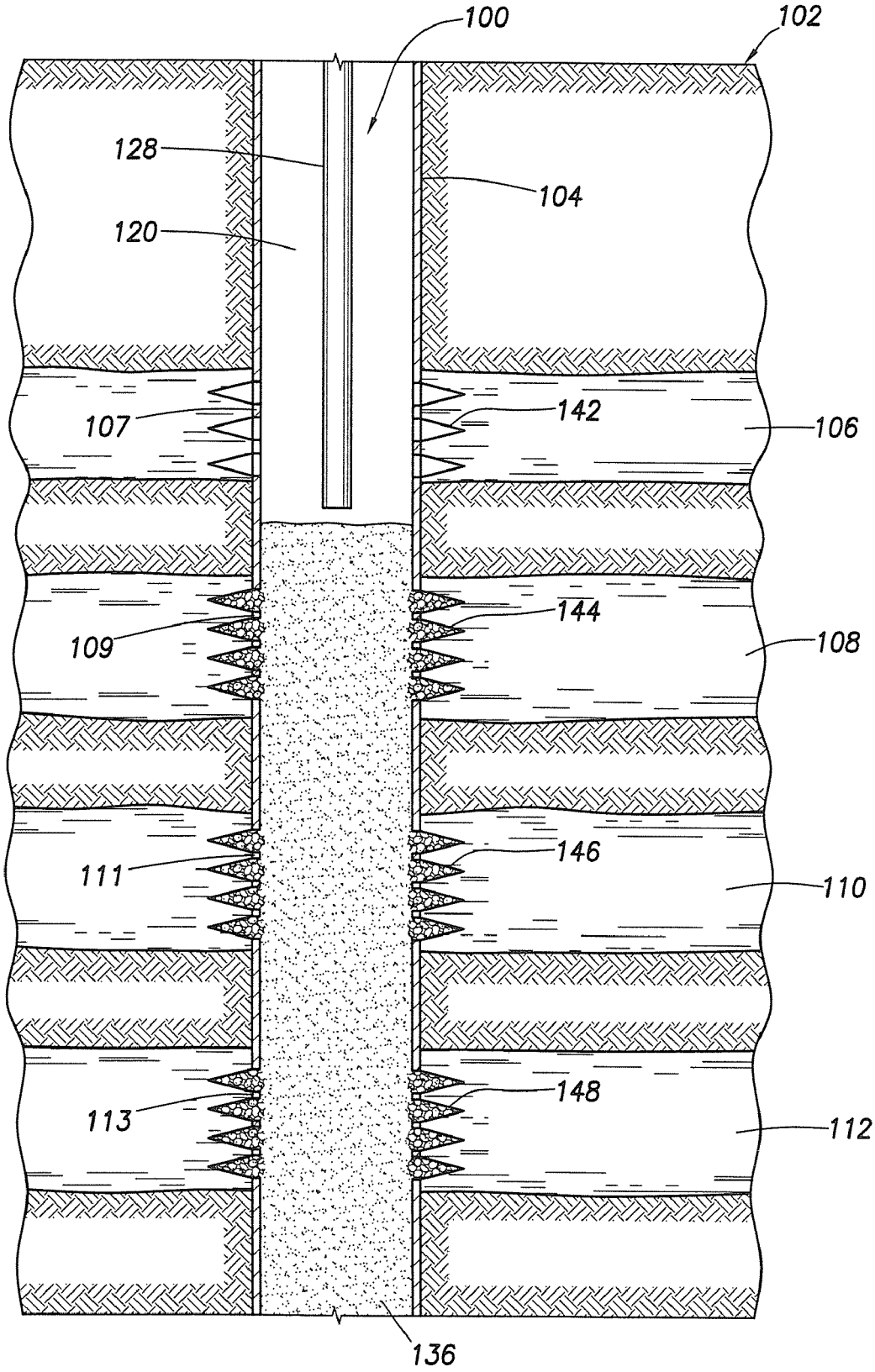
FIG. 2 illustrates a cross-sectional side view of the wellbore, wherein a plug of plugging particulate material has been formed in the bore of the casing, wherein the plug covers at least one perforation in the casing.

FIG. 2 illustrates a cross-sectional side view of the wellbore 100, wherein a plug 136 has been formed in the wellbore 100 of the casing 104, wherein the plug 136 covers at least one perforation in the casing 104, such as perforations 144 of second production interval 108. Although typically formed of sand, the plug 136 does not have to comprise sand. The plug 136 can be made up of any plugging particulate material of any material of a size capable of plugging the wellbore 100 while the exposed perforations above the plug 136 are packed with packing particulate material. For example, the plugging particulate material for the plug 136 can comprise sand or shell carbonate.

The plug 136 is preferably formed by inserting a conduit 128 through the wellbore 100 and injecting plugging particulate material from the conduit 128 into the wellbore 100. The conduit 128 is shown disposed in wellbore 100. Conduit 128 can be coiled tubing, jointed pipe, or any other suitable conduit for the delivery of fluids during subterranean operations. Annulus 120 is defined as the space between casing 104 and conduit 128. The setting of the plug 136 does not have to be precise because a conduit 100 can be run to the top of the plug 136 to determine the location of the plug 136 and confirm that only the perforations 142 of the uppermost production interval 106 are exposed.

Preferably, the step of forming a plug 136 further comprises leaving at least one perforation exposed above the upper portion of the plug 136. As illustrated in FIG. 2, perforations 142 of first production interval 106 have been left exposed above the second production interval 108. Alternatively, the upper portion of the plug 136 can be removed by lowering a conduit 128 into the wellbore 100 and circulating a washing fluid through the conduit 128 to remove the upper portion of the plug 136.

It should be understood by those skilled in the art that the upper portion of the plug 136 could be the uppermost production interval 106 that is to be packed with packing particulate material, or, alternatively, could comprise only a portion of the uppermost production interval 106. For example, the upper portion of the plug 136 can include only some of the perforations 142 of the first production interval 106, such that only some of the perforations are left exposed by the plug 136. Also, the upper portion of the plug 136 could be more than one production interval, such that the plugging particulate material of two or more production intervals are removed and packed with packing particular material at a time.

Figure 3:
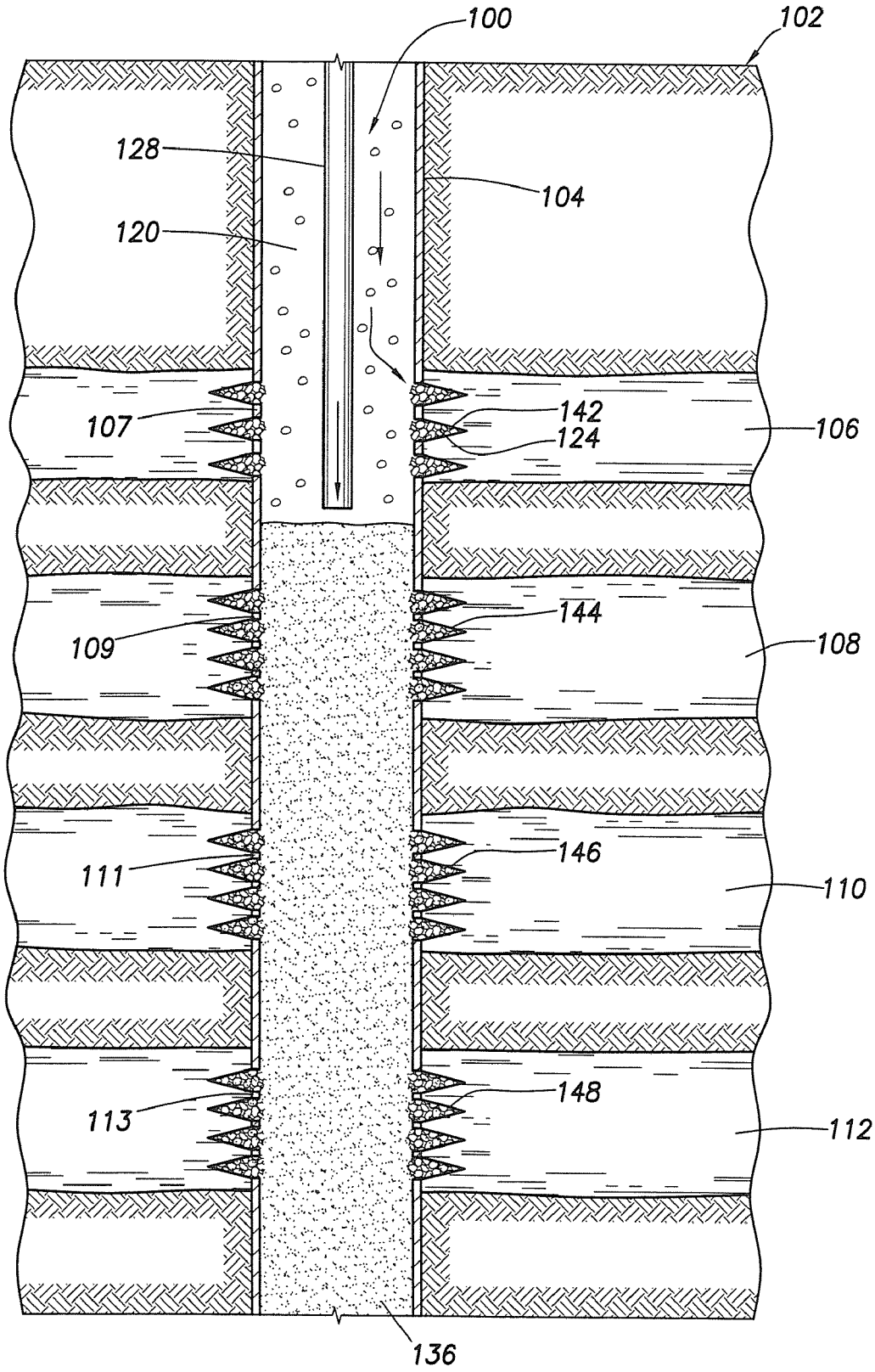
FIG. 3 illustrates a cross-sectional side view of the wellbore, wherein a pack of first packing particulate material is formed in the perforations in the casing located above the plug.

FIG. 3 illustrates a cross-sectional side view of the wellbore, wherein a pack 124 of first packing particulate material is formed in the perforations 142 of the first production interval 106 in the casing 104 located above the plug 136. To form the pack 124 of the first packing particulate material in the perforations 142 in the casing 104, a first carrier fluid with the first packing particulate is introduced or pumped into the wellbore 100 under conditions to form the pack 124 of the first packing particulate material in at least one perforation 142 located above the plug 136 in the casing 104.

As shown in FIG. 3, in accordance with one embodiment of the methods of the invention, a carrier fluid with first packing particulate material can be introduced into wellbore 100 by pumping the carrier fluid down conduit 128. In another embodiment, carrier fluid with first packing particulate material can be introduced into wellbore 100 by pumping the carrier fluid down annulus 120. The carrier fluid and the packing particulate material will be discussed further below. The method of the invention advantageously does not require the conduit 128 that introduces the first packing particulate material and first carrier fluid to be positioned adjacent the target perforations to be packed during the packing process. Thus, the new method avoids having to have conduit 128 below all perforations 142, 144, 146, 148 of a casing 104 during the packing process, thus avoiding the chances for the conduit 128 becoming stuck in the wellbore 100 by the packing particulate material. The carrier fluid and packing particulate material can be pumped down the annulus 120 and squeezed into the exposed perforations 142 of the uppermost production interval 106 until a significant packing pressure is obtained.

The packing particulate material in the carrier fluid should be allowed to pack into plurality of perforations 142, 144, 146, 148, thereby forming particulate packs 124 in each of the plurality of perforations 142, 144, 146, 148. Any suitable method can be used to introduce the carrier fluid into wellbore 100 so that particulate packs 124 are formed.

Generally, the carrier fluid can be introduced into wellbore 100 so that downhole pressures are sufficient for the carrier fluid to squeeze into production intervals 106, 108, 110, 112, but the downhole pressures are below the respective fracture gradients until plurality of perforations 142, 144, 146, 148 are effectively packed with particulates. Surface pumping pressures can be monitored to determine when particulate packs 124 have formed in each of the plurality of perforations 142, 144, 146, 148. For example, when the surface pumping pressures of the carrier fluid increase above a pressure necessary for the downhole pressures to exceed the fracture gradients of production intervals 106, 108, 110, 112 without fracturing of such intervals, particulate packs 124 should have formed in each of the plurality of perforations 142, 144, 146, 148.

In certain embodiments, back pressure should be held on annulus 120, among other things so that the carrier fluid enters plurality of perforations 142, 144, 146, 148 and is squeezed into the matrix of subterranean formation 102, so that carrier fluid is spread across plurality of perforations 142, 144, 146, 148, and so that carrier fluid maintains sufficient velocity for proppant suspension without exceeding fracturing pressures. In one embodiment, back pressure is applied on annulus 120 by limiting the return of the carrier fluid up through annulus 120 by utilizing a choke mechanism at the surface (not shown). As the carrier fluid enters plurality of perforations 142, 144, 146, 148 and is squeezed into the matrix of subterranean formation 102, the packing particulate material in the carrier fluid should bridge in plurality of perforations 142, 144, 146, 148 and thus pack into plurality of perforations 142, 144, 146, 148 forming particulate packs 124 therein. One of ordinary skill in the art will recognize other suitable methods for squeezing the carrier fluid into the matrix of subterranean formation 102.

Figure 4:
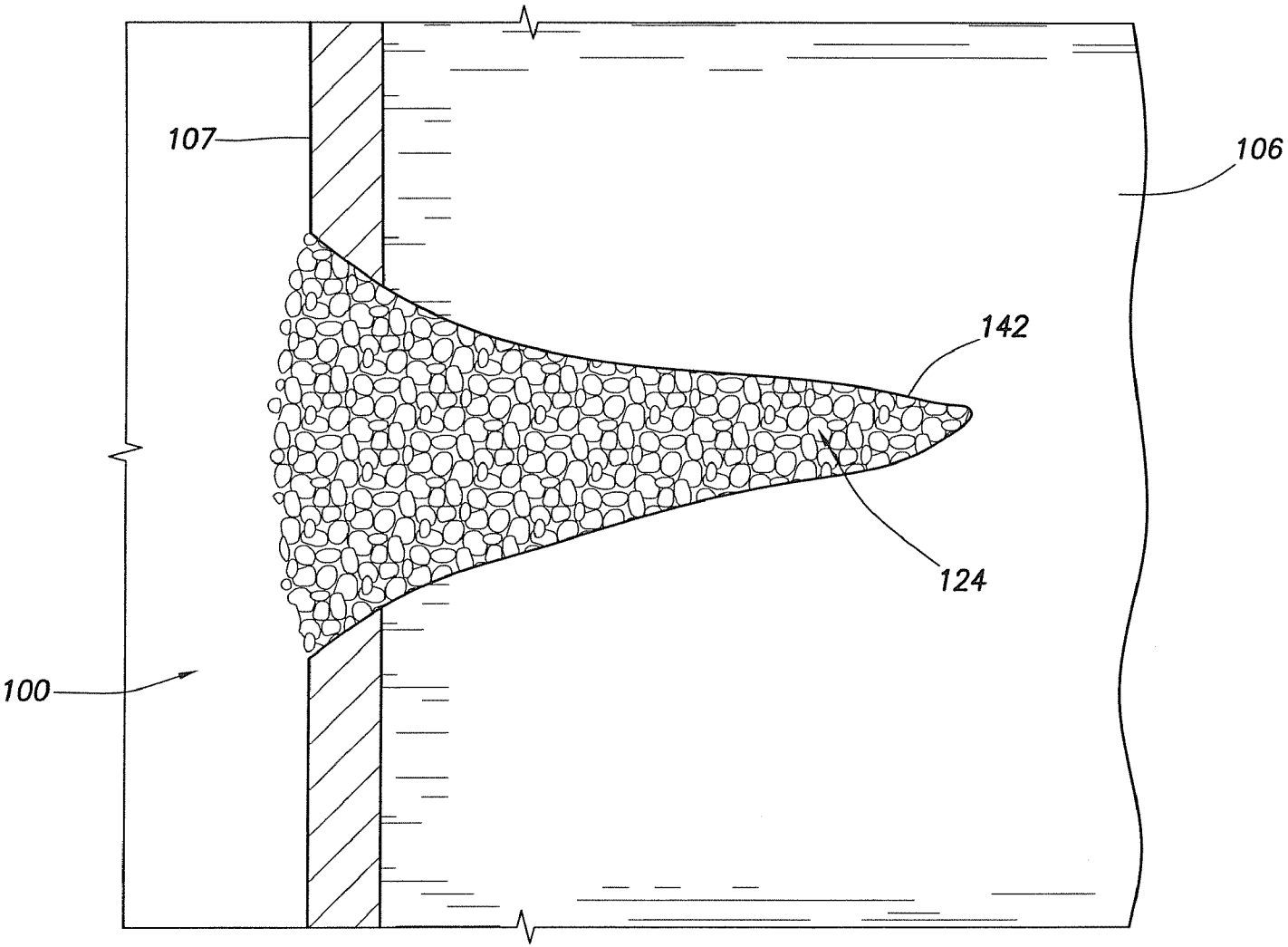
FIG. 4 illustrates a cross-sectional side view of perforation after having a first packing particulate material placed therein to form the particulate pack.

Turning now to FIG. 4, illustrated is a cross-sectional side view of a perforation 142 after having a first packing particulate material is placed therein to form the particulate pack 124.

Once the pack 124 of packing particulate material has achieved sufficient compressive strength, the at least an upper portion of the plug 136 is removed to expose the at least one perforation in the casing that had been previously covered by at least the upper portion of the plug 136. Referring to FIG. 5, the at least one perforation that is exposed by the removal of the upper portion of the plug 136 are the perforations 144 of the second production interval 108. Thus, the upper portion of the plug, which is the second production interval 108 in the illustration, is removed to expose the perforations 144 of the second production interval 108.

FIG. 5 illustrates a conduit 128 being lowered into the wellbore 100 and washing fluid that is being circulated to remove the upper portion of the plug 136 to expose at least one perforation 144 in the casing 104 that had been previously covered by at least the upper portion of the plug 136, here the second production interval 108 of the plug 136. While the conduit 128 is pumped down or lowered to the lower, or second production interval 108, any excess of the packing particulate material is removed or circulated out of the wellbore 100.

FIG. 6 illustrates a cross-sectional side view of the wellbore 100, wherein a pack of second packing particulate material is formed in at least one perforation 144 exposed by removing at least the upper portion of the plug 136. Thus, the perforations 144 in the casing 104 adjacent the lower production interval, here the second production interval 108, are exposed, and a pack of the first packing particulate material is formed in the perforations 144 in the casing adjacent the lower production interval 108 by introducing a second carrier fluid comprising second particulates into the wellbore 100. The second packing particulate can be the same or different than the first packing particulate, although it is preferably the same. For example, the first packing particulate material can be introduced into the packs with the first carrier fluid again.

The step of forming a pack of the second packing particulate material can comprise introducing a second carrier fluid with the second packing particulate material into the wellbore under conditions to form the pack of the second packing particulate material in the at least one perforation exposed by removing at least the upper portion of the plug. The carrier fluid and packing particulate material can be pumped down the annulus and squeezed into the exposed perforations of the upper production interval until a significant packing pressure is obtained.

In one embodiment according to the invention, at least a next upper portion of the plug 136 is removed to expose at least one perforation in the casing that had been previously covered by at least the next upper portion of the plug 136. The next upper portion of the plug 136 could be defined as removal of part or the entire next production interval. Referring to FIG. 6, the next production interval that will be removed is the third production interval 110 to expose perforations 146 of the third production interval 110.

The step of forming a pack of a next packing particulate material in the at least one perforation 146 exposed by removing the next upper portion of the plug 136 is then performed. The next packing particulate material can be the same or different from the first packing particulate material and the same or different from the second packing particulate material. The step of forming a pack of the next packing particulate material comprises introducing a next carrier fluid with the next packing particulate material into the wellbore 100 under conditions to form the pack of the next packing particulate material in the at least one perforation 146 exposed by removing the next upper portion of the plug 136.

FIG. 7 illustrates a cross-sectional side view of the wellbore 100, wherein all perforations 142, 144, 146, 148, in the casing 104 are packed with particulate material by successively repeating the steps of removing at least a next upper portion of the plug and forming a pack of a next packing particulate material. Thus, at least an upper portion of the sand can be removed to expose some of the perforations 142, 144, 146, 148, in the casing 104 and forming a pack of next packing particulate material in the perforations 142, 144, 146, 148, for each lower production interval 106, 108, 110, or 112 are repeated until all perforations 142, 144, 146, 148 are packed with next packing particulate material.

After the packs have been packed with packing particulate material, the well can be shut-in to allow the packing particulate material in the perforations 142, 144, 146, and 148 to consolidate and gain compressive strength.

In certain embodiments, once particulate packs 124 have been formed in plurality of perforations 142, 144, 146, and 148, particulate packs 124 can be contacted with a filling carrier fluid that contains filling particulate material. Generally, the filling particulate material is of a smaller size than any of the first, second, and next particulates so that the filling particulate material can plug at least a portion of the interstitial spaces between the first, second, and next particulates in particulate packs 124.

In one certain embodiment, the filling carrier fluid containing the filling particulate material can be introduced into wellbore 100 as the pad fluid for a stimulation operation performed on first production interval 106. The filling carrier fluid and filling particulate material will be discussed in more detail below. The filling carrier fluid for the filling particulate material can be introduced into wellbore 100 by any suitable manner, for example, by pumping the carrier fluid down conduit 128. Generally, the filling carrier fluid can be introduced into wellbore 100 so that downhole pressures are sufficient for the filling carrier fluid to squeeze into particulate packs 124 and into production intervals 106, 108, 110, 112, but the downhole pressures are below production intervals' 106, 108, 110, 112 respective fracture gradients.

In certain embodiments, back pressure should be held on annulus 120 so that the filling carrier fluid is squeezed into particulate packs 124 and thus into the matrix of subterranean formation 102, plugging at least portion of the interstitial spaces between the packing particulate material or second particulates in particulate packs 124, thereby forming a filter cake at the surface of particulate packs 124. When a filter cake has formed at the surface of particulate packs 124, the leak off rate of the filling carrier fluid into the matrix of subterranean formation 102 through particulate packs 124 should be reduced, as indicated by the rate of pressure fall off during shut-in immediately after pumping the filling carrier fluid.

The method of the invention can also comprise the step of perforating the casing to form at least one perforation in the casing 104 before or after any step of the method. In one embodiment, the step of perforating is performed after forming a pack 124 of a first packing particulate material in at least one perforation in the casing 104 located above the plug 136. In another embodiment, the step of perforating the casing 104 to form at least one perforation in the casing 104 located above the plug 136 is performed after forming a pack 124 of a first packing particulate material. In yet another embodiment, the step of perforating the casing 104 to form at lest one perforation in the casing 104 is performed at a location in the casing 104 that had been previously covered by the plug 136.

Referring now to FIG. 8, once particulate packs 124 are formed by the introduction of the carrier fluid into wellbore 100 and, if desired, filling carrier fluid is introduced into wellbore 100, the methods of the invention can further comprise perforating at least one remedial perforation 132 in casing 104 adjacent to a production interval (e.g., production interval 106).

The at least one remedial perforation in the casing adjacent to the production interval(s) can be stimulated through the at least one remedial perforation. One advantageous method of perforating and stimulating is described in U.S. patent application Ser. No. 11/004,441, processes of remedial perforation and/or stimulation can also be used. For example, a stimulation treatment can be simply pumped down the wellbore. The packed perforations are productive as is without perforation or stimulation. Also, the packed perforations can be stimulated without having to first perform a remedial perforation.

These perforations are referred to as "remedial" because they are created after an initial completion process has been performed in the well. Further, the at least one remedial perforation 132 can be created in one or more previously perforated intervals of casing 104 (e.g., casing intervals 107, 109, 111, 113) and/or one or more previously unperforated intervals of casing 104. The at least one remedial perforation 132 can penetrate through casing 104 and into a portion of subterranean formation 102 adjacent thereto. For example, the at least one remedial perforation 132 can penetrate through first casing interval 107 and into first production interval 106.

As illustrated in FIG. 8, hydraulic jetting tool 126 is shown disposed in wellbore 100. Hydraulic jetting tool 126 contains at least one port 127. Hydraulic jetting tool 126 can be any suitable assembly for use in subterranean operations through which a fluid can be jetted at high pressures, including those described in U.S. Pat. No. 5,765,642, the relevant disclosure of which is incorporated herein by reference. In one embodiment, hydraulic jetting tool 126 is attached to work string 128, in the form of piping or coiled tubing, which lowers hydraulic jetting tool 126 into wellbore 100 and supplies it with jetting fluid. Optional valve subassembly 129 can be attached to the end of hydraulic jetting tool 126 to cause the flow of the fluid (referred to herein as "jetting fluid") to discharge through at least one port 127 in hydraulic jetting tool 126. Annulus 120 is defined between casing 104 and work string 128.

In one embodiment, hydraulic jetting tool 126 is positioned in wellbore 100 adjacent to casing 104 in a location (such as first casing interval 107) that is adjacent to a production interval (such as first production interval 106). Hydraulic jetting tool 126 then operates to form at least one remedial perforation 132 by jetting the jetting fluid through at least one port 127 and against first casing interval 107. At least one remedial perforation 132 can penetrate through the first casing interval 107 and into first production interval 106 adjacent thereto. The jetting fluid can contain a base fluid (e.g., water) and abrasives (e.g., sand). In one embodiment, sand is present in the jetting fluid in an amount of about 1 pound per gallon of the base fluid. While the above description describes the use of hydraulic jetting tool 126 to create at least one remedial perforation 132 in first casing interval 107, any suitable method can be used create at least one remedial perforation 132 in first casing interval 107. Suitable methods include all perforating methods known to those of ordinary skill in the art, but are not limited to, bullet perforating, jet perforating, and hydraulic jetting.

In accordance with the methods of the invention, once at least one remedial perforation 132 has been created in casing 104 at the desired location (e.g., first casing interval 107 adjacent to first production interval 106), the subterranean formation 102 (e.g., first production interval 106) can be stimulated through the at least one remedial perforation 132. Referring to FIG. 9, illustrated is a cross-sectional side view of the wellbore after creation of fractures in an interval of the subterranean formation. The stimulation of first production interval can be commenced using hydraulic jetting tool 126 shown disposed in wellbore 100, in accordance with one embodiment of the invention. In these embodiments, once at least one remedial perforation 132 has been created in first casing interval 107 using hydraulic jetting tool 126, the stimulation fluid can be pumped into wellbore 100, down annulus 120, and into at least one remedial perforation 132 at a pressure sufficient to create or enhance at least one fracture 134 in subterranean formation 100, e.g., first production interval 106, along at least one remedial perforation 132.

While FIG. 9 depicts at least one fracture 134 as a longitudinal fracture that is approximately longitudinal or parallel to the axis of wellbore 100, those of ordinary skill in the art will recognize that the direction and orientation of the at least one fracture 134 is dependent on a number of factors, including rock mechanical stress, reservoir pressure, and perforation orientation. In certain embodiments, a jetting fluid can be pumped down through work string 128 and jetted through at least one port 127, through the at least one remedial perforation 132, and against first production interval 106, wherein hydraulic jetting tool 126 is positioned adjacent to at least one remedial perforation 132.

In certain embodiments, the step of jetting the jetting fluid against first production interval 106 can occur simultaneously with the pumping of the stimulation fluid into wellbore 100, down annulus 130, and into at least one remedial perforation 132, so as to create or enhance at least one fracture 134 in first production interval 106 along at least one remedial perforation 132. Proppant can be included in the stimulation fluid and/or the jetting fluid as desired so as to support at least one fracture 134 and prevent it from fully closing after hydraulic pressure is released. Suitable methods of fracturing a subterranean formation utilizing a hydraulic jetting tool are described in U.S. Patent Number 5,765,642, the relevant disclosure of which is incorporated herein by reference.

While the above description describes the use of hydraulic jetting tool 126 to create or enhance at least one fracture 134, any suitable method of stimulation can be used to stimulate the desired interval of subterranean formation 102, including, but are not limited to, hydraulic fracturing and fracture acidizing operations. In some embodiments, the stimulation of first production interval 106 comprises introducing a stimulation fluid into wellbore 100 and into at least one remedial perforation 132 so as to contact first production interval 106. In another embodiment, stimulation fluid is introduced into wellbore 100 so as to contact first production interval 106 at a pressure sufficient to create at least one fracture in first production interval 106.

In accordance with one embodiment of the invention, once the desired interval of subterranean formation 102, such as first production interval 106, has been stimulated, sufficient sand can be introduced into wellbore 100 via the stimulation fluid (e.g., annulus fluid, jetting fluid, or both) to form plug 136 in casing 104, as depicted in FIG. 10. Once the hydraulic pressure is released, the sand should settle to form plug 136 adjacent to first casing interval 107 extending above at least one remedial perforation 132. In some embodiments, plug 136 can be adjacent to first casing interval 107 extending from an optional mechanical plug to above at least one remedial perforation 132. Plug 136 acts to isolate the stimulated section of subterranean formation 102, e.g., first production interval 106. One of ordinary skill in the art will recognize other suitable methods of isolating the stimulated section of subterranean formation 102 that can be suitable for use with the methods of the invention.

Having perforated and stimulated a desired interval (such as first casing interval 107 and first production interval 106), in the manner described above, an operator can elect to repeat the above acts of perforating and stimulating for each of the remaining production intervals (such as production intervals 108, 110, 112). FIG. 10 illustrates a cross-sectional side view of the wellbore having a hydraulic jetting tool in position for perforating an interval of the wellbore. Thus, at least one remedial perforation 138 in casing 104 can be perforated adjacent to second production interval 108 and then stimulated through the at least one remedial perforation 138. In some embodiments, at least one remedial perforation 138 can be created in second casing interval 109 and a stimulation fluid can be introduced into wellbore 100 and into the at least one remedial perforation 138 created therein so as to contact the second production interval 108 of subterranean formation 106. In some embodiments, as illustrated in FIG. 10, hydraulic jetting tool 126 can be positioned adjacent to second casing interval 109 and used to create at least one remedial perforation 138 in second casing interval 109. Thereafter, in the manner described above, at least one fracture 140 can be created or enhanced along at least one remedial perforation 138. In certain embodiments of the invention wherein an operator uses the methods of the invention to stimulate multiple production intervals of subterranean formation 102 (such as production intervals 106, 108, 110, 112), the operator can elect to sequentially stimulate the production intervals intersected by wellbore 100, beginning with the deepest production interval (e.g., first production interval 106), and sequentially stimulating the shallower desired intervals, such as production intervals 108, 110, 112.

In certain embodiments, clean-out fluids optionally can be introduced into wellbore 100 by pumping down the conduit 128 into the wellbore 100. Generally, clean-out fluids, where used, can be introduced into wellbore 100 at any suitable time as desired by one of ordinary skill in the art, for example, to e.g., to clean out debris, cuttings, pipe dope, and other materials from wellbore 100 and inside equipment, such as conduit 128 or hydraulic jetting tool 126 that can be disposed in wellbore 100. For example, a clean out fluid can be used after completion of the stimulation operations so as to remove the plugs, such as plug 136 that can be in wellbore 100. In some embodiments, the clean out fluid can be used after the carrier fluid has been introduced into wellbore 100 so as to remove any of the packing particulate material that is loose in wellbore 100. Generally, the clean-out fluids should not be circulated into wellbore 100 at sufficient rates and pressures to impact the integrity of particulate packs 124. Generally, the cleaning fluid can be any conventional fluid used to prepare a formation for stimulation, such as water-based or oil-based fluids. In some embodiments, these cleaning fluids can be energized fluids that contain a gas, such as nitrogen or air.

While the above-described steps describe the use of conduit 128 to introduce the carrier fluid and the filling carrier fluid into wellbore 100, any suitable methodology can be used to introduce such fluids into wellbore 100. In some embodiments, work string 128 with hydraulic jetting tool 126 attached thereto and optional valve subassembly 129 attached to the end of hydraulic jetting tool 126 can be used in the above-described step of introducing the carrier fluid containing packing particulate material into wellbore 100. This can save at least one trip out of the wellbore, between the steps of packing the packing particulate material into plurality of perforations 142, 144, 146, 148 and perforating at least one remedial perforation 132 because the same downhole equipment can be used for both steps. For example, hydraulic jetting tool 126 can have a longitudinal fluid flow passageway extending therethrough and optional valve subassembly 129 can have a longitudinal fluid flow passageway extending therethrough. When optional valve subassembly 129 is not activated, fluid flows down through work string 128, into hydraulic jetting tool 126, and out through optional valve subassembly 129. Accordingly, in some embodiments, the carrier fluid can be introduced into wellbore 100 by pumping the carrier fluid down work string 128, into hydraulic jetting tool 126, and out into wellbore 100 through optional valve subassembly 129. Similarly, filling carrier fluid also can be introduced into wellbore 100. When desired to perform the above-described remedial perforation and/or stimulation steps, optional valve subassembly 129 should be activated thereby causing the flow of fluid to discharge through at least one port 127.

The first, second, and next carrier fluid for the first, second and next packing particulate material, respectively, can include any suitable fluids that can be used to transport packing particulates in subterranean operations. In one embodiment, the first, second, and next carrier fluid are selected to be the same. Suitable fluids for the first, second and third carrier fluid include ungelled aqueous fluids, aqueous gels, hydrocarbon-based gels, foams, emulsions, viscoelastic surfactant gels, and any other suitable fluid. Where the carrier fluid is an ungelled aqueous fluid, it should be introduced into the wellbore at a sufficient rate to transport the packing particulate material. Suitable emulsions can be comprised of two immiscible liquids such as an aqueous liquid or gelled liquid and a hydrocarbon. Foams can be created by the addition of a gas, such as carbon dioxide or nitrogen. Suitable aqueous gels are generally comprised of water and one or more gelling agents.

In a one embodiment, the carrier fluid for the packing particulate material is an aqueous gel comprised of water, a gelling agent for gelling the aqueous component and increasing its viscosity, and, optionally, a crosslinking agent for crosslinking the gel and further increasing the viscosity of the fluid. The increased viscosity of the gelled, or gelled and crosslinked, aqueous gels, inter alia, reduces fluid loss and enhances the suspension properties thereof. An example of a suitable crosslinked aqueous gel is a borate fluid system utilized in the "Delta Frac®" fracturing service, commercially available from Halliburton Energy Services, Duncan Okla. Another example of a suitable crosslinked aqueous gel is a borate fluid system utilized in the "Seaquest®" fracturing service, commercially available from Halliburton Energy Services, Duncan, Okla. The water used to form the aqueous gel can be fresh water, saltwater, brine, or any other aqueous liquid that does not adversely react with the other components. The density of the water can be increased to provide additional particle transport and suspension in the invention.

As mentioned above, the first, second, and next packing particulate material can be selected to be the same or different. The packing particulate material is selected to be of a size to pack a perforation 142, 144, 146, and 148 in the casing 104. Furthermore, the first, second, and next carrier fluid that carries first, second and next packing particulate material can be selected to be the same or different. The packing particulate material as used in accordance with the invention are generally particulate of a size such that the particulate bridge plurality of perforations 142, 144, 146, 148 in casing 104 and form proppant packs 124 therein. The packing particulate for use in the packing particulate material can have an average particle size in the range of from about 10 mesh to about 100 mesh. A wide variety of particulates can be used as the first, second, and next packing particulate material in accordance with the invention. For example, the first, second, and the next packing particulate material can be independently selected from the group consisting of sand; bauxite; ceramic materials; glass materials; polymer materials; synthetic fluorine-containing polymeric materials, e.g., TEFLON®; nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates; and combinations thereof. Suitable composite particulates can comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Generally, the packing particulate material can be present in the carrier fluid in an amount in an amount sufficient to form the desired proppant packs 124 in plurality of perforations 142, 144, 146, 148. In some embodiments, the packing particulate material, can be present in the carrier fluid in an amount in the range of from about 2 pounds to about 12 pounds per gallon of the carrier fluid not inclusive of the packing particulate material.

Generally, the packing particulate material does not degrade in the presence of hydrocarbon fluids and other fluids present in portion of the subterranean formation; this allows the packing particulate material to maintain their integrity in the presence of produced hydrocarbon products, formation water, and other compositions normally produced from subterranean formations. However, in some embodiments of the invention, the packing particulate material can comprise degradable materials. Degradable materials can be included in the packing particulate material, for example, so that proppant packs 124 can degrade over time. Such degradable materials are capable of undergoing an irreversible degradation downhole. The term "irreversible" as used herein means that the degradable material, once degraded downhole, should not recrystallize or reconsolidate, e.g., the degradable material should degrade in situ but should not recrystallize or reconsolidate in situ.

The degradable materials can degrade by any suitable mechanism. Suitable degradable materials can be water-soluble, gas-soluble, oil-soluble, biodegradable, temperature degradable, solvent-degradable, acid-soluble, oxidizer-degradable, or a combination thereof. Suitable degradable materials include a variety of degradable materials suitable for use in subterranean operations and can comprise dehydrated materials, waxes, boric acid flakes, degradable polymers, calcium carbonate, paraffins, crosslinked polymer gels, combinations thereof, and the like. One example of a suitable degradable crosslinked polymer gel is "Max Seal™" fluid loss control additive, commercially available from Halliburton Energy Services, Duncan, Okla. An example of a suitable degradable polymeric material is "BioBalls™" perforation ball sealers, commercially available from Santrol Corporation, Fresno, Tex.

In some embodiments, the degradable material comprises an oil-soluble material. Where such oil-soluble materials are used, the oil-soluble materials can be degraded by the produced fluids, thus degrading particulate packs 124 so as to unblock plurality of perforations 142, 144, 146, 148. Suitable oil-soluble materials include either natural or synthetic polymers, such as, for example, polyacrylics, polyamides, and polyolefins (such as polyethylene, polypropylene, polyisobutylene, and polystyrene).

Suitable examples of degradable polymers that can be used in accordance with the invention include, but are not limited to, homopolymers, random, block, graft, and star- and hyper-branched polymers. Specific examples of suitable polymers include polysaccharides (such as dextran or cellulose); chitin; chitosan; proteins; aliphatic polyesters; poly(lactide); poly(glycolide); poly(ε-caprolactone); poly(hydroxybutyrate); poly(anhydrides); aliphatic polycarbonates; poly(ortho esters); poly(amino acids); poly(ethylene oxide); polyphosphazenes; copolymers thereof; and combinations thereof. Polyanhydrides are another type of particularly suitable degradable polymer useful in the invention. Examples of suitable polyanhydrides include poly(adipic anhydride), poly(suberic anhydride), poly(sebacic anhydride), poly(dodecanedioic anhydride). Other suitable examples include but are not limited to poly(maleic anhydride) and poly(benzoic anhydride). One skilled in the art will recognize that plasticizers can be included in forming suitable polymeric degradable materials of the invention. The plasticizers can be present in an amount sufficient to provide the desired characteristics, for example, more effective compatibilization of the melt blend components, improved processing characteristics during the blending and processing steps, and control and regulation of the sensitivity and degradation of the polymer by moisture.

Suitable dehydrated compounds are those materials that will degrade over time when rehydrated. For example, a particulate solid dehydrated salt or a particulate solid anhydrous borate material that degrades over time can be suitable. Specific examples of particulate solid anhydrous borate materials that can be used include but are not limited to anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are substantially soluble in water as compared to anhydrous borate materials and as a result degrade in the aqueous fluid.

Blends of certain degradable materials and other compounds can also be suitable. One example of a suitable blend of materials is a mixture of poly(lactic acid) and sodium borate where the mixing of an acid and base could result in a neutral solution where this is desirable. Another example would include a blend of poly(lactic acid) and boric oxide. In choosing the appropriate degradable material or materials, one should consider the degradation products that will result. The degradation products should not adversely affect subterranean operations or components. The choice of degradable material also can depend, at least in part, on the conditions of the well, e.g., wellbore temperature. For instance, lactides have been found to be suitable for lower temperature wells, including those within the range of 60° F. to 150° F., and polylactides have been found to be suitable for wellbore temperatures above this range. Poly(lactic acid) and dehydrated salts can be suitable for higher temperature wells. Also, in some embodiments a preferable result is achieved if the degradable material degrades slowly over time as opposed to instantaneously. In some embodiments, it can be desirable when the degradable material does not substantially degrade until after the degradable material has been substantially placed in a desired location within a subterranean formation.

In certain embodiments of the invention, the packing particulates are coated with an adhesive substance. As used herein, the term "adhesive substance" refers to a material that is capable of being coated onto a particulate and that exhibits a sticky or tacky character such that the proppant particulates that have adhesive thereon have a tendency to create clusters or aggregates. As used herein, the term "tacky," in all of its forms, generally refers to a substance having a nature such that it is (or can be activated to become) somewhat sticky to the touch. Generally, the packing particulates can be coated with an adhesive substance so that the packing particulate material once placed within plurality of perforations 142, 144, 146, 148 to form particulate packs 124 can consolidate into the packing particulate material into a hardened mass. Adhesive substances suitable for use in the invention include non-aqueous tackifying agents; aqueous tackifying agents; silyl-modified polyamides; and curable resin compositions that are capable of curing to form hardened substances.

Tackifying agents suitable for use in the consolidation fluids of the invention comprise any compound that, when in liquid form or in a solvent solution, will form a non-hardening coating upon a particulate. A particularly preferred group of tackifying agents comprise polyamides that are liquids or in solution at the temperature of the subterranean formation such that they are, by themselves, non-hardening when introduced into the subterranean formation. A particularly preferred product is a condensation reaction product comprised of commercially available polyacids and a polyamine. Such commercial products include compounds such as mixtures of $C_{36}$ dibasic acids containing some trimer and higher oligomers and also small amounts of monomer acids that are reacted with polyamines. Other polyacids include trimer acids, synthetic acids produced from fatty acids, maleic anhydride, acrylic acid, and the like. Such acid compounds are commercially available from companies such as Witco Corporation, Union Camp, Chemtall, and Emery Industries. The reaction products are available from, for example, Champion Technologies, Inc. and Witco Corporation. Additional compounds which can be used as tackifying compounds include liquids and solutions of, for example, polyesters, polycarbonates and polycarbamates, natural resins such as shellac and the like. Other suitable tackifying agents are described in U.S. Pat. Nos. 5,853,048 and 5,833,000, the relevant disclosures of which are herein incorporated by reference.

Tackifying agents suitable for use in the invention can be either used such that they form a non-hardening coating or they can be combined with a multifunctional material capable of reacting with the tackifying compound to form a hardened coating. A "hardened coating" as used herein means that the reaction of the tackifying compound with the multifunctional material will result in a substantially non-flowable reaction product that exhibits a higher compressive strength in a consolidated agglomerate than the tackifying compound alone with the particulates. In this instance, the tackifying agent can function similarly to a hardenable resin. Multifunctional materials suitable for use in the invention include, but are not limited to, aldehydes such as formaldehyde, dialdehydes such as glutaraldehyde, hemiacetals or aldehyde releasing compounds, diacid halides, dihalides such as dichlorides and dibromides, polyacid anhydrides such as citric acid, epoxides, furfuraldehyde, glutaraldehyde or aldehyde condensates and the like, and combinations thereof. In some embodiments of the invention, the multifunctional material can be mixed with the tackifying compound in an amount of from about 0.01 to about 50 percent by weight of the tackifying compound to effect formation of the reaction product. In some preferable embodiments, the compound is present in an amount of from about 0.5 to about 1 percent by weight of the tackifying compound. Suitable multifunctional materials are described in U.S. Pat. No. 5,839,510, issued Nov. 24, 1998, with inventors Jim D. Weaver; Philip D. Nguyen; James R. Stanford; Bobby K. Bowles; Steven F. Wilson; Cole R. Clay; Mark A. Parker; Brahmadeo T. Dewprashad, the relevant disclosure of which is herein incorporated by reference. Other suitable tackifying agents are described in U.S. Pat. No. 5,853,048, issued Dec. 29, 1998, with inventors Jim D. Weaver; James R. Stanford; Philip D. Nguyen; Bobby K. Bowles; Steven F. Wilson; Brahmadeo Dewprashad; Mark A. Parker.

Solvents suitable for use with the tackifying agents of the invention include any solvent that is compatible with the tackifying agent and achieves the desired viscosity effect. The solvents that can be used in the invention preferably include those having high flash points (most preferably above about 125° F.). Examples of solvents suitable for use in the invention include, but are not limited to, butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d'limonene, 2-butoxy ethanol, butyl acetate, furfuryl acetate, butyl lactate, dimethyl sulfoxide, dimethyl formamide, fatty acid methyl esters, and combinations thereof. It is within the ability of one skilled in the art, with the benefit of this disclosure, to determine whether a solvent is needed to achieve a viscosity suitable to the subterranean conditions and, if so, how much.

Suitable aqueous tackifier agents are capable of forming at least a partial coating upon the surface of the packing particulates. Generally, suitable aqueous tackifier agents are not significantly tacky when placed onto a particulate, but are capable of being "activated" (that is destabilized, coalesced and/or reacted) to transform the compound into a sticky, tackifying compound at a desirable time. Such activation can occur before, during, or after the aqueous tackifier compound is placed in the subterranean formation. In some embodiments, a pretreatment can be first contacted with the surface of a particulate to prepare it to be coated with an aqueous tackifier compound. Suitable aqueous tackifying agents are generally charged polymers that comprise compounds that, when in an aqueous solvent or solution, will form a non-hardening coating (by itself or with an activator) and, when placed on a particulate, will increase the continuous critical resuspension velocity of the particulate when contacted by a stream of water.

Examples of aqueous tackifier agents suitable for use in the invention include, but are not limited to, acrylic acid polymers, acrylic acid ester polymers, acrylic acid derivative polymers, acrylic acid homopolymers, acrylic acid ester homopolymers (such as poly(methyl acrylate), poly (butyl acrylate), and poly(2-ethylhexyl acrylate)), acrylic acid ester co-polymers, methacrylic acid derivative polymers, methacrylic acid homopolymers, methacrylic acid ester homopolymers (such as poly(methyl methacrylate), poly (butyl methacrylate), and poly(2-ethylhexyl methacryate)), acrylamido-methyl-propane sulfonate polymers, acrylamido-methyl-propane sulfonate derivative polymers, acrylamido-methyl-propane sulfonate co-polymers, and acrylic acid/acrylamido-methyl-propane sulfonate co-polymers and combinations thereof. Methods of determining suitable aqueous tackifier agents and additional disclosure on aqueous tackifier agents can be found in U.S. patent application Ser. No. 10/864,061 and filed Jun. 9, 2004 and U.S. patent application Ser. No. 10/864,618 and filed Jun. 9, 2004, the relevant disclosures of which are hereby incorporated by reference.

Silyl-modified polyamide compounds suitable for use as an adhesive substance in the methods of the invention can be described as substantially self-hardening compositions that are capable of at least partially adhering to particulates in the unhardened state, and that are further capable of self-hardening themselves to a substantially non-tacky state to which individual particulates such as formation fines will not adhere. Such silyl-modified polyamides can be based, for example, on the reaction product of a silating compound with a polyamide or a mixture of polyamides. The polyamide or mixture of polyamides can be one or more polyamide intermediate compounds obtained, for example, from the reaction of a polyacid (e.g., diacid or higher) with a polyamine (e.g., diamine or higher) to form a polyamide polymer with the elimination of water. Other suitable silyl-modified polyamides and methods of making such compounds are described in U.S. Pat. No. 6,439,309, issued Aug. 27, 2002, having named inventors Ronald M. Matherly, Allan R. Rickards, and Jeffrey C. Dawson; the relevant disclosure of which is herein incorporated by reference.

Curable resin compositions suitable for use in the consolidation fluids of the invention generally comprise any suitable resin that is capable of forming a hardened, consolidated mass. Many such resins are commonly used in subterranean consolidation operations, and some suitable resins include two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, can be cured with an internal catalyst or activator so that when pumped down hole, they can be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F. It is within the ability of one skilled in the art, with the benefit of this disclosure, to select a suitable resin for use in embodiments of the invention and to determine whether a catalyst is required to trigger curing.

Further, the curable resin composition further can contain a solvent. Any solvent that is compatible with the resin and achieves the desired viscosity effect is suitable for use in the invention. Preferred solvents include those listed above in connection with tackifying compounds. It is within the ability of one skilled in the art, with the benefit of this disclosure, to determine whether and how much solvent is needed to achieve a suitable viscosity.

The filling carrier fluid that can be used in accordance with the invention can include any suitable fluids that can be used to transport the filling particulates in subterranean operations. Suitable fluids include ungelled aqueous fluids, aqueous gels, hydrocarbon-based gels, foams, emulsions, viscoelastic surfactant gels, and any other suitable fluid. Where the filling carrier fluid is an ungelled aqueous fluid, it should be introduced into the wellbore at a sufficient rate to transport the packing particulate material. Suitable emulsions can be comprised of two immiscible liquids such as an aqueous liquid or gelled liquid and a hydrocarbon. Foams can be created by the addition of a gas, such as carbon dioxide or nitrogen. Suitable aqueous gels are generally comprised of water and one or more gelling agents. In some embodiments, the filling carrier fluid is an aqueous gel comprised of water, a gelling agent for gelling the aqueous component and increasing its viscosity, and, optionally, a crosslinking agent for crosslinking the gel and further increasing the viscosity of the fluid. The increased viscosity of the gelled, or gelled and crosslinked, aqueous gels, inter alia, reduces fluid loss and enhances the suspension properties thereof. An example of a suitable crosslinked aqueous gel is a borate fluid system utilized in the "Delta Frac®" fracturing service, commercially available from Halliburton Energy Services, Duncan Okla. Another example of a suitable crosslinked aqueous gel is a borate fluid system utilized in the "Seaquest®" fracturing service, commercially available from Halliburton Energy Services, Duncan, Okla. The water used to form the aqueous gel can be fresh water, saltwater, brine, or any other aqueous liquid that does not adversely react with the other components. The density of the water can be increased to provide additional particle transport and suspension in the invention.

As mentioned above, the filling carrier fluid contains filling particulate material. The filling particulate material used in accordance with the invention are generally particulate materials having an average particle size smaller than the average particle size of the packing particulate material so that the filling particulates can plug at least a portion of the interstitial spaces between the packing particulate material in packs 124. In certain embodiments, the filling particulate material used can have an average particle size of less than about 100 mesh. The filling particulate material can be selected to be the same as the first packing particulate material and the second packing particulate material except for the size of the filling particulate material. Examples of suitable particulate materials that can be used as the second particulates include, but are not limited to, silica flour; sand; bauxite; ceramic materials; glass materials; polymer materials; synthetic fluorine-containing polymeric materials, e.g., TEFLON®; nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates; and combinations thereof. Suitable composite particulates can comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Generally, the filling particulate material should be included in the filling carrier fluid in an amount sufficient to form the desired filter cake on the surface of proppant packs 124. In certain embodiments, the filling particulate material can be present in the filling carrier fluid in an amount in the range of from about 30 pounds to about 100 pounds per 1,000 gallons of the filling carrier fluid not inclusive of the filling particulate material. In certain embodiments, the filling particulate material can comprise degradable particulates of the type described above.

The stimulation and jetting fluids that can be used in accordance with the invention can include any suitable fluids that can be used in subterranean stimulation operations. In some embodiments, the stimulation fluid can have substantially the same composition as the jetting fluid. Suitable fluids include ungelled aqueous fluids, aqueous gels, hydrocarbon-based gels, foams, emulsions, viscoelastic surfactant gels, acidizing treatment fluids (e.g., acid blends) and any other suitable fluid. In some embodiments, the stimulation fluid and/or jetting fluid can contain an acid. Where the stimulation or jetting fluid is an ungelled aqueous fluid, it should be introduced into the wellbore at a sufficient rate to transport proppant (where present). Suitable emulsions can be comprised of two immiscible liquids such as an aqueous gelled liquid and a liquefied, normally gaseous, fluid, such as carbon dioxide or nitrogen. Foams can be created by the addition of a gas, such as carbon dioxide or nitrogen. Suitable aqueous gels are generally comprised of water and one or more gelling agents.

In some embodiments, the jetting fluid and/or stimulation fluid is an aqueous gel comprised of water, a gelling agent for gelling the aqueous component and increasing its viscosity, and, optionally, a crosslinking agent for crosslinking the gel and further increasing the viscosity of the fluid. The increased viscosity of the gelled, or gelled and crosslinked, aqueous gels, inter alia, reduces fluid loss and enhances the suspension properties thereof. The water used to form the aqueous gel can be fresh water, saltwater, brine, or any other aqueous liquid that does not adversely react with the other components. The density of the water can be increased to provide additional particle transport and suspension in the invention. One of ordinary skill in the art, with the benefit of this disclosure, will be able to determine the appropriate stimulation and/or jetting fluid for a particulate application.

Optionally, proppant can be included in the stimulation fluid, the jetting fluid, or both. Among other things, proppant can be included to prevent fractures formed in the subterranean formation from fully closing once the hydraulic pressure is released. A variety of suitable proppant can be used, for example, sand; bauxite; ceramic materials; glass materials; polymer materials; synthetic fluorine-containing polymeric materials, e.g., TEFLON®; nut shell pieces; seed shell pieces; cured resinous particulates comprising nut shell pieces; cured resinous particulates comprising seed shell pieces; fruit pit pieces; cured resinous particulates comprising fruit pit pieces; wood; composite particulates; and combinations thereof. Suitable composite particulates can comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. One of ordinary skill in the art, with the benefit of this disclosure, should know the appropriate amount and type of proppant to include in the jetting fluid and/or stimulation fluid for a particular application.

The invention also provides a method of forming packs in a plurality of perforations in a casing of the wellbore, the method comprising the steps of: (a) forming a plug of a plugging particulate material in the wellbore of the casing, wherein the plug covers at least one perforation in the casing, and wherein at least one perforation is left exposed above the upper portion of the plug; (b) forming a pack of a first packing particulate material in at least one perforation in the casing located above the plug; (c) removing at least an upper portion of the plug to expose the at least one perforation in the casing that had been previously covered by at least the upper portion of the plug; (d) forming a pack of a second packing particulate material in the at least one perforation exposed by removing at least the upper portion of the plug, wherein the second packing particulate material can be the same or different from the first packing particulate material; (e) perforating the casing to form at least one perforation in the casing; and (f) stimulating through the at least one perforation.

The invention also provides a method of forming packs in a plurality of perforations in a casing of the wellbore, the method comprising the steps of: (a) forming a plug of a plugging particulate material in the wellbore of the casing, wherein the plug covers at least one perforation in the casing, and wherein at least one perforation is left exposed above the upper portion of the plug; (b) forming a pack of a first packing particulate material in at least one perforation in the casing located above the plug; (c) removing at least an upper portion of the plug to expose the at least one perforation in the casing that had been previously covered by at least the upper portion of the plug; (d) forming a pack of a second packing particulate material in the at least one perforation exposed by removing at least the upper portion of the plug, wherein the second packing particulate material can be the same or different from the first packing particulate material; (e) perforating the casing to form at least one perforation in the casing by positioning a hydraulic jetting tool adjacent to the casing and jetting a jetting fluid through the hydraulic jetting tool and against the casing; and (f) stimulating through the at least one perforation by jetting a jetting fluid through the at least one nozzle in the hydraulic jetting tool into the at least one perforation.

After careful consideration of the specific and some embodiments of the invention described herein, a person of ordinary skill in the art will appreciate that certain modifications, substitutions and other changes can be made without substantially deviating from the principles of the invention. The detailed description is illustrative, the spirit and scope of the invention being limited only by the appended Claims.

What is claimed is:

1. A method of forming packs in a plurality of perforations in a casing of a wellbore, the method comprising the steps of:

a) forming a plug of a plugging particulate material in the wellbore of the casing, wherein the plug covers at least one perforation in the casing;

b) forming a pack of a first packing particulate material in at least one perforation located above the plug in the casing;

c) removing at least an upper portion of the plug to expose the at least one perforation in the casing that had been previously covered by at least the upper portion of the plug; and d) forming a pack of a second packing particulate material in the at least one perforation exposed by removing at least the upper portion of the plug, wherein the second packing particulate material can be the same or different from the first packing particulate material.

2. The method according to claim 1, further comprising the steps of:

a) removing at least a next upper portion of the plug to expose at least one perforation in the casing that had been previously covered by at least the next upper portion of the plug; and b) forming a pack of a next packing particulate material in the at least one perforation exposed by removing the next upper portion of the plug, wherein the next packing particulate material can be the same or different from the first packing particulate material and the same or different from the second packing particulate material.

3. The method according to claim 2, wherein:

a) the step of forming a pack of the first packing particulate material comprises introducing a first carrier fluid with the first packing particulate material into the wellbore under conditions to form the pack of the first packing particulate material in at least one perforation located above the plug in the casing;

b) the step of forming a pack of the second packing particulate material comprises introducing a second carrier fluid with the second packing particulate material into the wellbore under conditions to form the pack of the second packing particulate material in the at least one perforation exposed by removing at least the upper portion of the plug; and c) the step of forming a pack of the next packing particulate material comprises introducing a next carrier fluid with the next packing particulate material into the wellbore under conditions to form the pack of the next packing particulate material in the at least one perforation exposed by removing the next upper portion of the plug.

4. The method according to claim 3, wherein the first carrier fluid, the second carrier fluid, and the next carrier fluid are independently selected from the group consisting of: an ungelled aqueous fluid, an aqueous gel, a hydrocarbon-based gel, a foam, and a viscoelastic surfactant gel.

5. The method according to claim 3, wherein the first packing particulate material, the second packing particulate material, and the next packing particulate material are independently selected from the group consisting of: sand, bauxite, ceramic materials, glass materials, polymer materials, synthetic fluorine-containing polymeric materials, nut shell pieces, seed shell pieces, cured resinous particulates comprising nut shell pieces, cured resinous particulates comprising seed shell pieces, fruit pit pieces, cured resinous particulates comprising fruit pit pieces, wood, composite particulates, and any mixture thereof in any proportion.

6. The method according to claim 3, wherein the first packing particulate material, the second packing particulate material, and the next packing particulate material are selected to be of a size to pack a perforation in the casing.

7. The method according to claim 1, wherein the at least one perforation in the casing located above the plug and the at least one perforation that has been exposed by removing at least the upper portion of the plug are in different production intervals.

8. The method according to claim 1, wherein the step of forming a plug further comprises leaving at least one perforation exposed above the upper portion of the plug.

9. The method according to claim 1, wherein the step of forming a plug comprises: inserting a conduit through the casing of the wellbore; and injecting the plugging particulate material through the conduit into the wellbore.

10. The method according to claim 1, wherein the plugging particulate material is selected from the group consisting of: sand, carbonate shell, and any mixture thereof in any proportion.

11. The method according to claim 1, wherein the step of removing at least an upper portion of the plug comprises: lowering a conduit into the wellbore; and circulating a washing fluid through the conduit to remove at least the upper portion of the plugging particulate material.

12. The method according to claim 1, further comprising the step of filling the at least some of the interstitial spaces in at least one of the previously formed packs.

13. The method according to claim 12, wherein the step of filling comprises: contacting at least one of the previously formed packs with a filling particulate material, wherein the filling particulate material is selected to be of a size to fill the interstitial spaces in at least one of the previously formed packs.

14. The method according to claim 1, further comprising, before or after any step of the method, perforating the casing to form at least one perforation in the casing.

15. The method according to claim 14, wherein the step of perforating is performed after forming a pack of a first packing particulate material in at least one perforation in the casing located above the plug.

16. The method according to claim 15, wherein the step of perforating the casing to form at least one perforation in the casing is performed at a location in the casing that had been previously covered by the plug.

17. The method according to claim 14, wherein the step of perforating the casing to form at least one perforation comprises positioning a hydraulic jetting tool adjacent to the casing and jetting a jetting fluid through the hydraulic jetting tool and against the casing.

18. The method according to claim 1, further comprising the step of stimulating a subterranean formation through the at least one perforation in the casing.

19. The method according to claim 16, further comprising the step of stimulating a subterranean formation through the at least one perforation in the casing.

20. The method according to claim 19, wherein the step of stimulating comprises introducing a stimulation fluid into an annulus defined between a work string and the casing so as to contact the at least one perforation with the stimulation fluid.

21. The method according to claim 19, wherein the step of stimulating comprises jetting a jetting fluid through the at least one nozzle in the hydraulic jetting tool into the at least one perforation.

22. The method according to claim 21, wherein the stimulating further comprises the steps of: a) introducing a stimulation fluid into an annulus defined between a work string and the casing so as to contact the stimulation fluid with the at least one perforation; and (b) simultaneously jetting a jetting fluid through the at least one nozzle in the hydraulic jetting tool into the at least one perforation.

23. A method of forming packs in a plurality of perforations in a casing of a wellbore, the method comprising the steps of:

a) forming a plug of a plugging particulate material in the wellbore of the casing, wherein the plug covers at least one perforation in the casing, and wherein at least one perforation is left exposed above the upper portion of the plug;

b) forming a pack of a first packing particulate material in at least one perforation in the casing located above the plug;

c) removing at least an upper portion of the plug to expose the at least one perforation in the casing that had been previously covered by at least the upper portion of the plug;

d) forming a pack of a second packing particulate material in the at least one perforation exposed by removing at least the upper portion of the plug, wherein the second packing particulate material can be the same or different from the first packing particulate material;

e) perforating the casing to form at least one perforation in the casing; and f) stimulating through the at least one perforation.

24. A method of forming packs in a plurality of perforations in a casing of a wellbore, the method comprising the steps of:

a) forming a plug of a plugging particulate material in the wellbore of the casing, wherein the plug covers at least one perforation in the casing, and wherein at least one perforation is left exposed above the upper portion of the plug;

b) forming a pack of a first packing particulate material in at least one perforation in the casing located above the plug;

c) removing at least an upper portion of the plug to expose the at least one perforation in the casing that had been previously covered by at least the upper portion of the plug;

d) forming a pack of a second packing particulate material in the at least one perforation exposed by removing at least the upper portion of the plug, wherein the second packing particulate material can be the same or different from the first packing particulate material;

e) perforating the casing to form at least one perforation in the casing by positioning a hydraulic jetting tool adjacent to the casing and jetting a jetting fluid through the hydraulic jetting tool and against the casing; and stimulating through the at least one perforation by jetting a jetting fluid through the at least one nozzle in the hydraulic jetting tool into the at least one perforation.

* * * * *